United States Patent [19]

Nack et al.

[11] 4,102,111

[45] Jul. 25, 1978

[54] WRAPPING MACHINE

[75] Inventors: Michael R. Nack; Gary M. Le Tourneau, both of Green Bay, Wis.

[73] Assignee: FMC Corporation, San Jose, Calif.

[21] Appl. No.: 691,662

[22] Filed: Jun. 1, 1976

[51] Int. Cl.[2] ..... B65B 9/10

[52] U.S. Cl. ..... 53/182 R; 53/373

[58] Field of Search ..... 53/180 R, 180 M, 182 R, 53/373

[56] References Cited

U.S. PATENT DOCUMENTS

| | | | |
|---|---|---|---|
| 3,340,673 | 9/1967 | Cloots | 53/180 R |
| 3,347,015 | 10/1967 | Nutting et al. | 53/182 R |
| 3,439,471 | 4/1969 | Kraft | 53/182 R |
| 3,513,629 | 5/1970 | Hoagland | 53/182 R |
| 3,657,856 | 4/1972 | Planner | 53/180 X |
| 3,738,081 | 6/1973 | Heinzer | 53/180 R |

FOREIGN PATENT DOCUMENTS

| | | | |
|---|---|---|---|
| 2,356,614 | 11/1973 | Fed. Rep. of Germany | 53/180 R |

*Primary Examiner*—Othell M. Simpson
*Assistant Examiner*—John Sipos
*Attorney, Agent, or Firm*—L. J. Pizzanelli; C. E. Tripp

[57] ABSTRACT

A wrapping machine of the horizontal form, fill and seal type, in which a continuously moving web strip is formed into a tube of thermoplastic material, has introduced therein a file of longitudinally spaced articles. A transverse sealing and cutting mechanism, coordinated with the lengths of each article and with the velocity of the tube, seals and cuts the web between articles to produce individually wrapped articles. To conserve wrapping material and to produce a wrinkle-free tight wrap, there is disclosed tucking devices, cooperating with the sealing and cutting mechanism, which, in addition to tucking, creates smooth well-defined folds at the ends of each package. More particularly, the tucking devices are in one embodiment, rotated about axes located on either side of the web tube path with the speed of rotation being such that the tucking devices closely approximate the speed of the web since tucking occurs during web movement. In another embodiment, the tucking devices, while also rotated about axes located as stated above, are articulated and maintained in a fixed orientation.

7 Claims, 15 Drawing Figures

20
22
24
25
26
27
28
30
31
32
34
36
38
40
42
44
46
48
50
52
54
56
58
62
64
72
76
90
92
94
WR
P
A

FIG_10
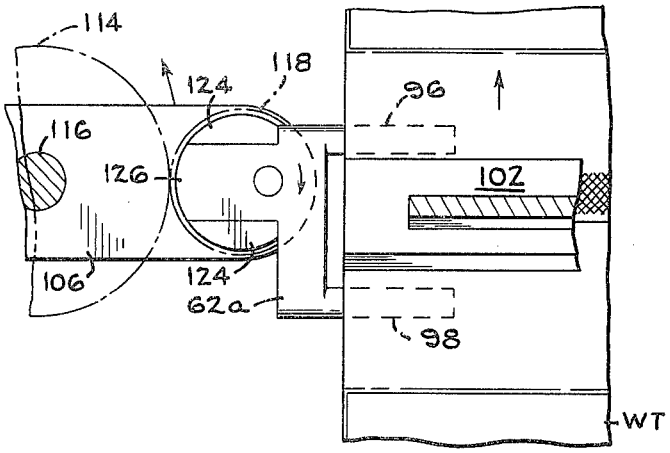
FIG_11
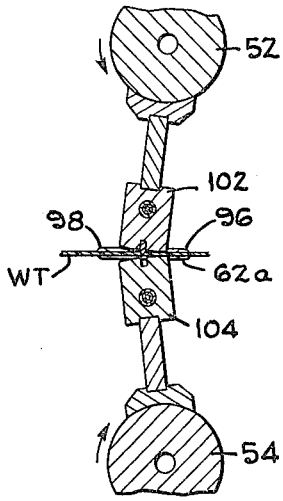
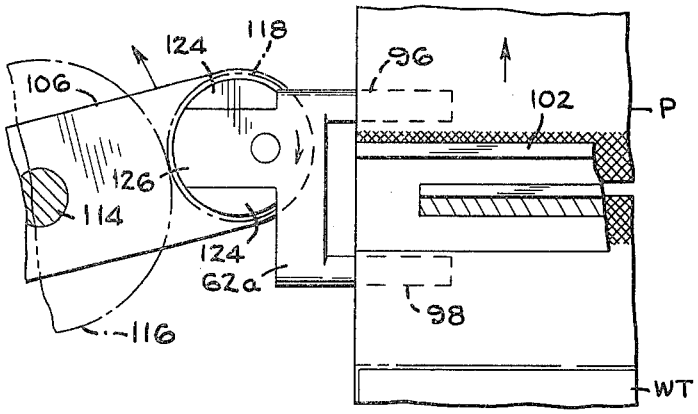
FIG_12
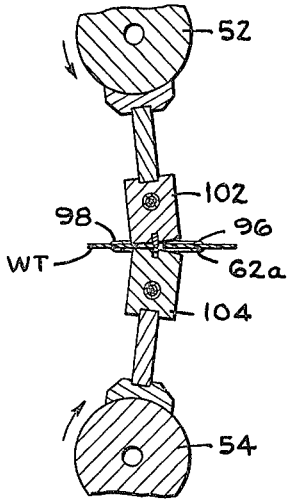
FIG_13
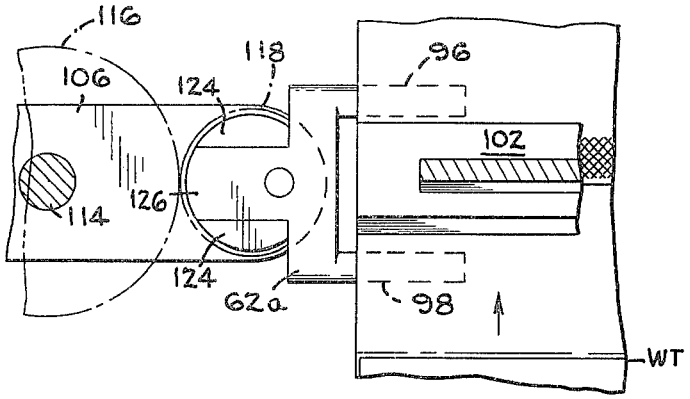
FIG_14

WRAPPING MACHINE

BACKGROUND OF THE INVENTION

1. Field of the Invention

This invention relates to continuous motion horizontal form, fill and seal packaging machines and more particularly tucking devices for forming predetermined creases in the wrapping material.

2. Description of the Prior Art

The United States patent application to Aterianus Ser. No. 581,993, which is assigned to the assignee of the present application, discloses tucking devices associated with a horizontal form, fill and seal packaging machine. The tucking devices comprise cooperating opposed members that perform tucking while the web tube is in motion.

The Heinzer U.S. Pat. No. 3,007,295 filed June 23, 1960, discloses a similar type packaging machine also incorporating tucking devices for slightly pinching the web inwardly between consecutive articles.

The Chalmers U.S. Pat. No. 2,179,685 filed May 7, 1938, discloses a series of folding elements that tuck and fold wrapping material on the end of a rigid container. The folded wrap assumes a pattern which is generally similar to a diamond fold.

The Campbell U.S. Pat. No. 2,602,276 filed Feb. 27, 1946, discloses a horizontal form, fill and seal machine which is combined with sequentially operable folding elements that press the ends of the pillow package against and around the end of the article packaged.

The Heinzer U.S. Pat. No. 3,738,081 filed June 3, 1971, relates to a horizontal form, fill and seal packaging machine which incorporates tucking elements associated and movable with the transverse sealing and cutting head.

SUMMARY OF THE INVENTION

The present invention discloses two forms of tucking mechanisms which are improvements over the tucking mechanisms disclosed in the above-mentioned Aterianus application. Essentially, the present invention, although disclosing opposed pairs of tucking mechanisms that are substantially simultaneously operable and are actuated so as to move, while tucking, in the direction of web movement and thus minimize or eliminate relative movement between the web and the tuckers, discloses tucking members that are more effective to create well defined creases and thereby consistently produce pillow packages whose end seals are free of wrinkles. Achieving this result is brought about by the configuration of the opposed side tucking members each of which take the form of two fingers which are sufficiently spaced apart to receive therebetween the opposed rotary transverse sealing and cutting head. The sealing and cutting head in addition, and since it is synchronously operable with the side tuckers, is effective to deflect and thus tuck the upper and lower panels of the web immediately before sealing and severing. Upon reaching the inward tucking limit, the side tuckers, since their fingers are on either side or straddle the sealing and severing head, are thus adjacent and partially coextensive with the narrow zone of the sealed web portion. Accordingly, it is a feature of the disclosed tucking mechanism to create smooth well defined creases extending from the entubed product to the transverse sealing zone and such creases are maintained until the transverse seal is produced.

It is another feature of the tucking mechanism of the present invention to produce better control of the film. By incorporating, at one station, devices for tucking, sealing and cutting, problems, arising from separate concurrently driven tucking, sealing and cutting stations, as disclosed in Aterianus Ser. No. 581,993, are eliminated. With a separate downstream sealing and cutting station it is essential that all influences that retard or advance the film be removed or operate properly in order that sealing and cutting occurs along a predetermined line between the entubed articles. Performing these operations at one station eliminates such problems.

According to one form of the disclosed invention, the finger-like side tucking elements are formed to avoid interference with the currently formed seal and are rotated at a speed such that the peripheral speed of the fingers is equal to the speed of the film. The fingers approach and withdraw from the film in an arc. Since the fingers are relatively closely adjacent and coextensive with the seal, one of the fingers is undercut or tapered so that the tendency to disturb the seal is minimized or eliminated.

Another embodiment incorporating the concept and principles of the present invention also comprises finger-like side tucking members but while mounted for rotation as in the above-mentioned embodiment, their orientation is maintained during rotation. More specifically, the tucking fingers of this embodiment approach and withdraw from the web tube such that the fingers are always facing or directed toward the centerline of the web tube path. The major advantage achieved is that the likelihood of the tucking fingers disturbing or tearing open the seal, which at this point is still slightly soft and easily rupturable, is obviated.

BRIEF DESCRIPTION OF THE DRAWINGS

FIG. 9A is a perspective of the gear mounting the tucking fingers, FIGS. 10 and 11 illustrate, in plan and in side elevation, the limit of inward travel of the tucking fingers and the position of the transverse sealing and severing jaws at that moment, FIGS. 12 and 13 are similar to FIGS. 10 and 11 but illustrate the relationship as tucking fingers are withdrawn and the concurrent position of the sealing and severing head, FIG. 14 is a slightly modified form of the orbiting tucking finger showing the finger as being located symmetrical with the shank or root of the tucking member.

DESCRIPTION OF THE PREFERRED EMBODIMENTS

The above-mentioned Aterianus United States application Ser. No. 581,993 is, by reference thereto, incorporated in the present disclosure. The essence of the structural and descriptive content of that application, to the extent that it is deemed necessary for an understanding of the present disclosure, is contained herein but certain details of construction which are common to Aterianus and the present disclosure are not repeated.

Figures 1, 2:
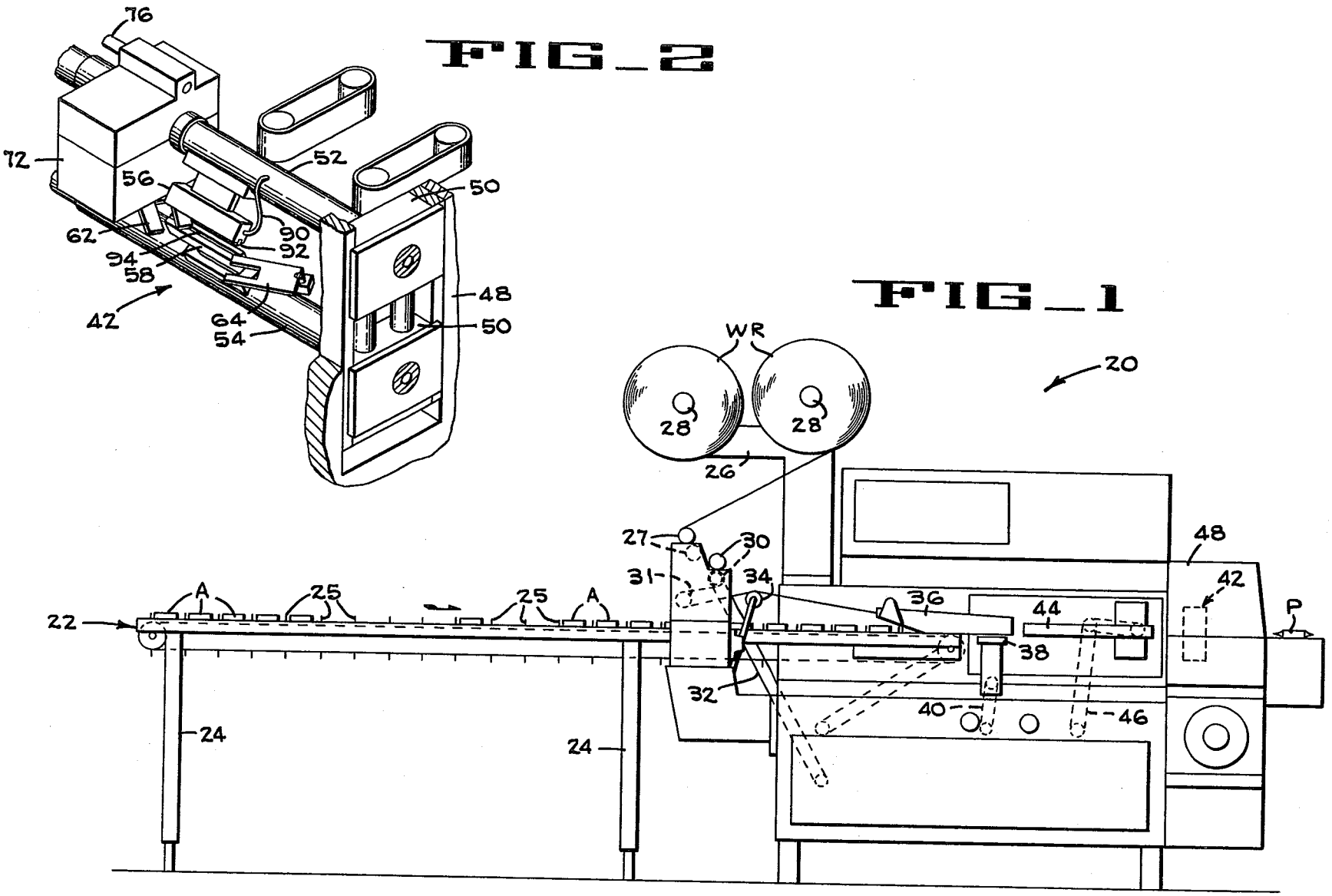
FIG. 1 is a side elevation of a horizontal form, fill and seal packaging machine incorporating the principles of the present invention.
FIG. 2 is a perspective, with parts broken away, of the tucking, sealing and cutting station.

The horizontal form, fill and seal machine, shown in FIG. 1 and generally identified by the numeral 20, comprises an infeed lug conveyor 22 which is supported at the proper elevation by legs 24. The conveyor receives, either automatically or manually, a plurality of articles A which, by virtue of the equal spacing of lugs 25, produce a single file of equally longitudinally spaced articles. An unwind stand 26 supports web rolls WR of thermoplastic material which are mounted on unwind shafts 28 carried by the stand 26. One roll, to the left as viewed in FIG. 1, is a reserve roll whose use can be initiated after the other roll is exhausted. The web strip is passed over rolls 27, between drive rolls 30 driven by sprocket chain 32, over roll 31 and over tensioning roll 34. The web, after passing over the tensioning roll 34, is machined to assume a tubular configuration by a forming box 36 and the articles fed thereto are accordingly received within the web tube. The longitudinal edges of the formed web are sealed to each other by sealing rolls 38 driven by a sprocket and chain arrangement 40. The entubed articles are fed to a tucking, sealing and severing head 42 by laterally spaced tubing belts 44 driven by sprockets and chains 46. The resulting package P is discharged from the machine by a conveyor, not shown.

Figure 3:
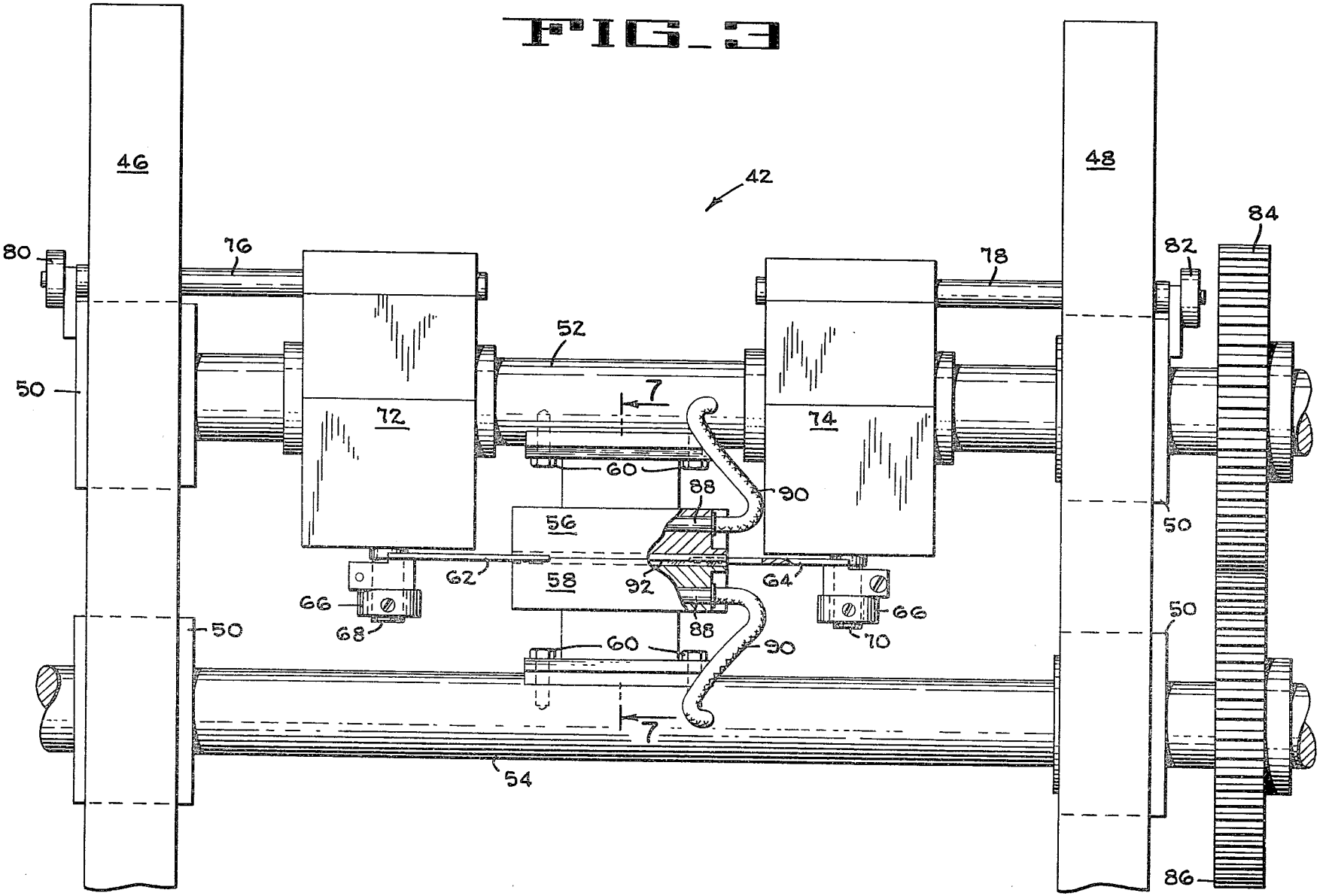
FIG. 3 is an enlarged transverse section, partly in section, of the rotary tucking fingers and their relationship with the transverse sealing and cutting head.

The drive for the novel tucking devices of the present invention, which are shown in FIGS. 2 and 3, are substantially identical to the drive shown and described in the United States application to Aterianus Ser. No. 581,993 therefore a detailed description thereof is not believed necessary for an understanding of the present invention. The tucking, sealing and severing head 42 comprises laterally spaced side plates 46 and 48 rotatably mounting, by means of bearings 50, transversely extending vertically spaced upper and lower shafts 52 and 54, respectively. Generally centrally and extending radially of each shaft, tucking, sealing and severing jaws 56 and 58 are rigidly mounted, by fasteners 60, to the shafts 52 and 54. Tucking devices 62 and 64, cooperating with jaws 56 and 58, are rigidly secured by collars 66 to shafts 68 and 70 projecting from gear boxes 72 and 74 mounted on and driven by the upper shaft 52. Each of the gear boxes is mounted for lateral adjustment relative to the centerline of the web path and are held stationary by rods 76 and 78 which extend through bores formed in the side plates 46 and 48. To effect lateral adjustment of the gear boxes the ends of the rods 76 and 78 are bored and threaded to receive adjusting screws 80 and 82 which establish and maintain the lateral position of the gear boxes 72 and 74.

On one end of each of the shafts 52 and 54 gears 84 and 86 are keyed. Driving torque to the shaft 54 is transferred to the shaft 52 by the gears 84 and 86 to thereby rotate these shafts in opposite directions. As a consequence jaws 56 and 58 simultaneously contact the formed web tube WT (FIG. 4) to effect tucking, sealing and severing. Concurrently therewith the shafts 68 and 70 mounting the tucking devices 62 and 64 are synchronously rotated so that the opposed side portions of the web tube are engaged at substantially the same moment as engagement is made by the jaws 56 and 58.

Figure 7:
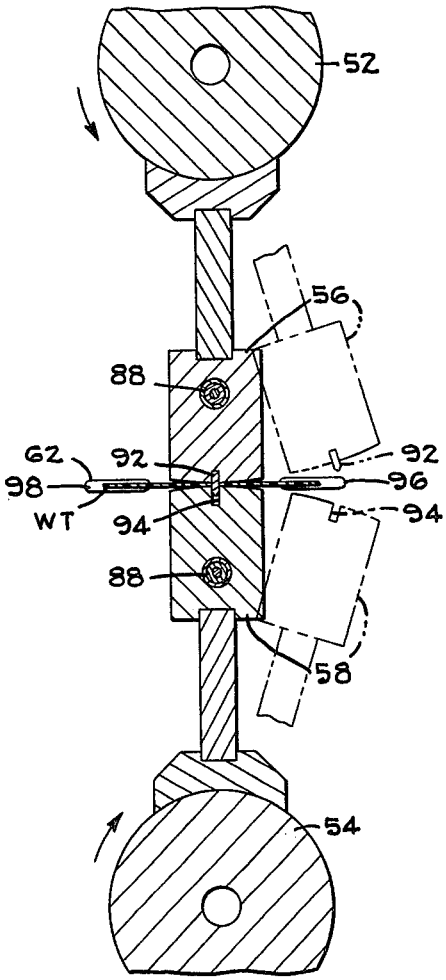
FIG. 7 is an enlarged transverse section, taken substantially along the line 7—7 of FIG. 3, illustrating the relationship of the side tucking members and the transverse seal and severing jaws at that point where the web tube has been sealed and severed.

To effect sealing of the web tube the jaws 56 and 58 are provided with electrical heaters 88 which are connected to a source of electrical power through leads 90 connected to conventional slip rings which are not shown. Moreover, transverse severing of the web tube is accomplished by a knife 92, secured to the jaw 56, and a slot 94 formed in the jaw 58 (FIG. 7).

FIG. 2 illustrates the general form of the side tucking devices incorporating the concepts and principles of the present invention. Generally the side tucking devices 62 and 64 may be made from a flat plate taking a configuration whereby a pair of projecting fingers are defined. The space or gap between the fingers is at least equal to the width SW of the transverse seals TS created by the jaws 56 and 58.

Figure 4:
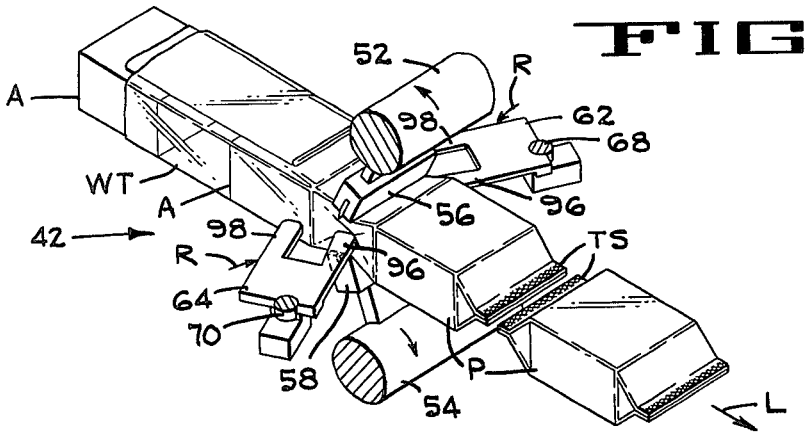
FIG. 4 is a diagrammatic perspective illustrating the action of the opposed tucking members as contact with the web tube is made.
Figure 5:
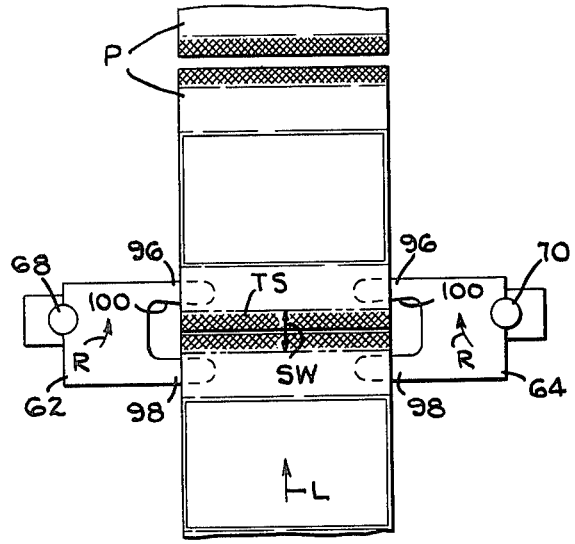
FIGS. 5 and 6 are plan diagrammatic views showing, respectively, the rotary tucking fingers fully projected into the web tube and the relationship they assume with the transverse seals and the relative position of the tucking members as they withdraw from the web tube.
Figure 6:
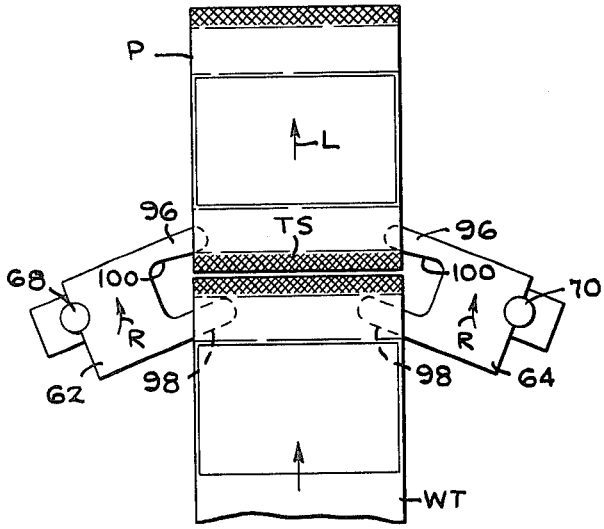

In describing the construction and mode of operation of the rotary tucking fingers reference is now made to FIGS. 4, 5, 6 and 7. As shown in FIG. 4 the web tube WT has located therein a single file of longitudinally spaced articles A. Tucking, severing and sealing occurs in that portion of the web tube between articles. The machine is appropriately timed so that substantially concurrent contact with the web tube is made by the opposed upper and lower tuckers 56 and 58 and the side tuckers 62 and 64. As mentioned above the side tuckers are preferably made of a flat plate which is formed to provide laterally spaced projecting fingers 96 and 98. The minimum spacing between the fingers is slightly greater than the width SW of the seal pattern and it will be seen that it extends for the entire lateral dimension of the web tube WT. With reference to FIG. 5 it will be observed that when the tuckers 62 and 64 have reached the limit of their inward travel the pairs of tucking fingers 96 and 98 straddle or are on either side of the transverse seal TS and are contiguous and partially coextensive with the seal TS. The fingers assume the position shown in FIG. 5 at the instant the tucking and sealing jaws 56 and 58 (FIG. 7) are located in a common vertical plane. Since the web tube WT is moving at a constant rate in the direction of the arrows L and the tucking fingers 62 and 64 are rotated in the direction of the arrows R at an angular velocity such that the top speed of the fingers 96 and 98 match or substantially match the velocity of the web tube, the tucking fingers (as shown in FIG. 6) assume the relative position after tucking, sealing and severing has occurred. While it is preferably to make the respective fingers 96 and 98 as long as possible and the lateral spacing therebetween equal to or substantially equal to the width SW of the seal TS, retraction or removal of the tucking fingers would disturb and possibly destroy the integrity of the seal. It is therefore necessary to limit the inward travel of the tucking fingers 96 and 98 to space them apart a distance slightly greater than the width of the seal pattern TS so that, as the tucking fingers are withdrawn (FIG. 6), interference with the seal is prevented or minimized. Thus, according to the present invention the tucking fingers 96 of the respective tuckers 62 and 64 are formed with a trailing edge 100 which is undercut or tapered to minimize or prevent interference with the seals.

Another constructional arrangement incorporating the concepts and principles of the present invention is shown in FIGS. 8, 9, 9A and 10–10A. The basic difference of the disclosed modification relates to the manner in which the side tucking members are actuated and, as will be made apparent hereafter, such tucking members are preferably actuated by a planetary gear arrangement which maintains respective tucking devices in a fixed orientation. Thus, the opposed synchronously operable tucking devices approach, tuck and withdraw from the web while maintaining a fixed orientation relative to the web tube. However, as in the first described embodiment, the tucking devices are operated so that no or an absolute minimum of relative velocity is created between them and the web tube. For convenience the same numerals will be used to indicate elements and components which are identical to those of the first described embodiment.

Figure 8:
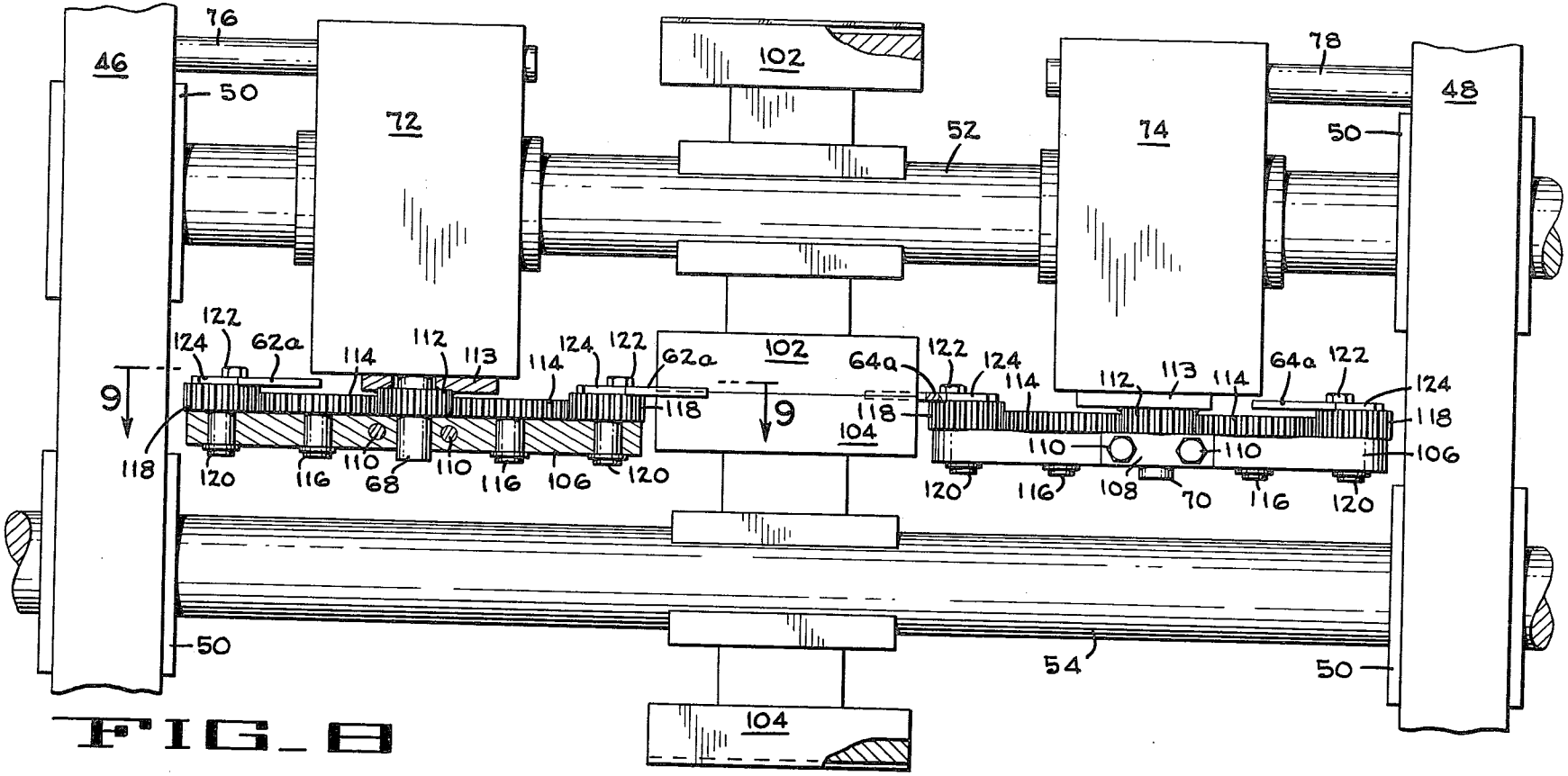
FIG. 8 is a transverse elevational view of the tucking, sealing and severing head showing the modified form of the side tucking elements.
Figure 8A:
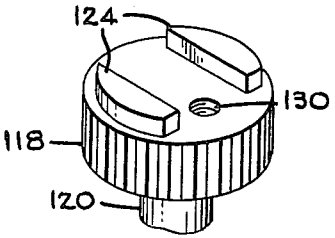
Figure 9:
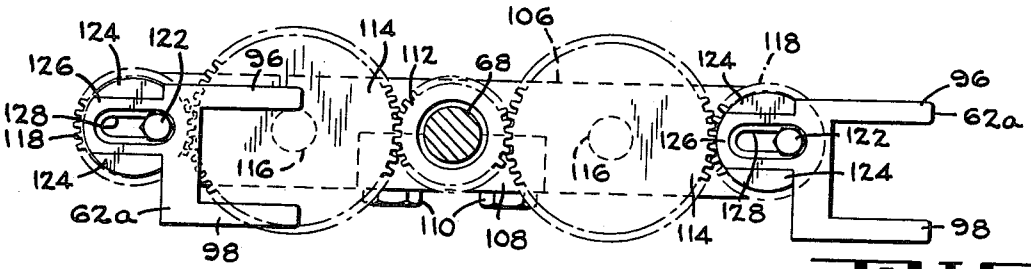
FIG. 9 is a section taken substantially along the line 9—9 of FIG. 8 illustrating the drive for the tucking fingers.

Referring to FIGS. 8, 9 and 9A it will be observed that the shafts 52 and 54 each carry laterally aligned diametrically opposed tucking, sealing and severing bars 102 and 104. In the art such a configuration is referred to as a "two up head" since for each 360° revolution of the shafts 52 and 54 two packages are produced. Otherwise, the mode of operation and constructional arrangement of each of the sealing bars are identical to that described hereinabove. On each of the shafts 68 and 70 projecting from the gear boxes 72 and 74 there is rigidly secured an elongated carrier 106 which is adjustably clamped to the respective shafts by a clamping block 108 which is fixed thereto by suitable fasteners 110. A central pinion gear 112 is fixed to a plate 113 secured to the lower surface of gear boxes 72 and 74. Diametrically opposed idler gears 114 in mesh with pinion 112 are mounted for rotation on short stub shafts 116 mounted in the carrier 106. Each of the idler gears are in meshing engagement with outboard gears 118 rotatably mounted on short stub shafts 120 which are also mounted in the carrier 106. Each of the gears 118 have adjustably secured thereto, by means of a bolt 122, tucking devices **62*a* and 64*b*. As shown in FIG. 9A the outboard gears 118 are formed with projecting ears 124 that define therebetween a slot in which is slidably disposed a shank portion 126 (FIG. 9) of the tucking devices 62*a* and 64*a*. The shank 126 is formed with an elongated slot 128 in which is disposed the bolt 122. A tapped hole 130 threadedly receives the bolt 122**. By this construction it will be apparent that the tucking devices can be radially adjusted between certain limits as may be required by the package size and/or the creasing and tucking characteristics of the web which may be used.

Since the gear 112 is stationary, rotation of the shafts 68 and 70 cause rotation of the carrier 106 and gears 114 and 118. Gears 112 and 118 are of the same pitch and diameter therefore for each revolution of the carrier 106 gears 118 also complete one revolution. Thus the tucking devices by virtue of the gear arrangement are always oriented so that the fingers 96 and 98 are always facing the web tube WT.

Referring now to FIGS. 10 and 11 it will be observed that the tucking device of this modification is offset such that one of the fingers 96 (the leading finger) is closer to the axis of the shank 126 than the other. This configuration has been found desirable since oftentimes the upper and lower tucking devices 102 and 104 will have commenced sealing the web tube before the side tuckers have reached their inner limit of travel. This condition of course will cause penetration of the web by the fingers and thus destroy the integrity of the package. Accordingly, by offsetting the tucking fingers 96 as shown in FIG. 10 the inward limit of travel is reached before the transverse bars 104 and 102 commence sealing of the web. The concurrent position of the seal bar 104 and 102 when the tucking device **62*a* is in the position illustrated in FIG. 10, is shown in FIG. 11. After the web tube has been tucked by the transverse and side tuckers, withdrawal of the tucking devices commences and this condition is shown in FIG. 12. Since the tucking device maintains a predetermined orientation the problem of disturbing the seal is avoided thus rendering unnecessary a special configuration to the tucking fingers. As in FIG. 11, FIG. 13 shows the orientation of the transverse bars 104 and 102 when the tucking device is in the position illustrated in FIG. 12**.

Although it is possible to form the tucking device so that the fingers 96 and 98 are symmetrical with the shank 126 (FIG. 14), care must be taken to synchronize the operation of the jaws 102 and 104. Should web sealing occur before the tuckers reach their inward limit of travel, web rupture or seal disturbance may occur.

Although the best mode contemplated for carrying out the present invention has been herein shown and described, it will be apparent that modification and variation may be made without departing from what is regarded to be the subject matter of the invention.

What is claimed is:

1. In a horizontal form, fill and seal wrapping machine including means for continually unwinding and forming a strip of thermoplastic web material into a tube, means for depositing longitudinally spaced articles in said tube and cooperating opposed pairs of rotary tucking means moving in the direction of web movement to engage and tuck web portions between said spaced articles, said rotary tucking means being rotatable about spaced pairs of axes lying in the same or substantially the same plane disposed transversely of the direction of movement of the web tube, the improvement in said tucking means comprising means for concurrently driving said tucking means to substantially simultaneously engage the tuck and opposed panels of the web tube, one pair of said tucking means being heated and provided with web severing means to, respectively, seal and sever the web tube along a line in said plane transverse to the direction of web movement and closely adjacent to said articles, the seal formed by said one pair of tucking means being generally in the form of a rectangle located adjacent said spaced articles and extending from one to the other edge of the web tube, and the other pair of said tucking means each consisting of integral fingers spaced a fixed distance laterally of each other and while tucking the opposed web tube portions toward each other said fingers being positioned on either side of said heated tucking means and thus straddling the web tube portion while sealing and severing occurs, said fingers of said other pair of tucking means in withdrawing from the tucked and sealed web tube avoid interference with the seal.

2. In a horizontal form, fill and seal wrapping machine including means for continually unwinding and forming a strip of thermoplastic web material into a tube, means for depositing longitudinally spaced articles in said tube, and cooperating opposed pairs of tucking means moving in the direction of web movement to engage and tuck web portions between said spaced articles; the improvement in said tucking means comprising means for concurrently driving said tucking means to substantially simultaneously engage and tuck the opposed panels of the web tube; one pair of said tucking means being heated and provided with web severing means to, respectively, seal and sever the web tube along a line transverse to the direction of web movement; the other pair of tucking means being formed with integral laterally spaced fingers that, while tucking the opposed web tube portions toward each other, are positioned on either side of said heated tucking means and thus straddle the web tube portion while sealing and severing occurrs; and means for maintaining said other pair of tucking means in a fixed orientation relative to said tube of web material; said means for maintaining the orientation of said other tucking means comprising an elongate rigid member rotatable in a plane normal to its axis of rotation a tucking device mounting member rotatably secured to and spaced from the axis of rotation of said rigid member, and drive means operable during rotation of said rigid member for concurrently rotating said tucking device mounting member in a direction opposite to the direction of rotation of said elongate rigid member and at a rate that maintains said tucking means in a desired orientation.

3. The wrapping machine according to claim 2 wherein said drive means comprises a gear arrangement.

4. The wrapping machine according to claim 3 wherein said gear arrangement comprises a stationary gear, an idler gear freely rotatably mounted on said rigid member and in mesh with said stationary gear, and a gear mounting said tucking device and driven by said idler gear, said last mentioned gear while being carried by said rigid member rotates relative thereto and thus maintains the fingers of said other tucking means oriented along lines generally normal to the longitudinal axis of said web tube.

5. In a wrapping machine adapted to receive spaced articles entubed within a moving tube of thermoplastic material, the combination of: a pair of opposed heated rotary tucking, sealing and cutting jaws mounted for rotation about spaced first axes lying in a plane transverse to and above and below the path of the web tube; a pair of rotary blade-like tucking devices mounted for rotation about axes also lying in said plane but being located at either side of the web tube and being normal to said first mentioned axes, and means for rotating said pair of jaws and said pair of devices in the same direction and at substantially the same speed as the tube when contacting the tube between adjacent articles for tightly tucking the web against the adjacent ends of the adjacent articles, and for sealing and cutting the tube at an area between and closely adjacent to said articles, said seals being generally rectangular and extending across the entire width of the collapsed tube portions; said tucking, sealing and cutting operations taking place at substantially the same time while the jaws and devices are moving through said transverse plane; each of said blade-like tucking devices being formed with laterally spaced fingers located on either side and closely adjacent the seals being produced by said heated rotary tucking jaws, said blade-like tucking devices in withdrawing from the web tube avoid interference with the seal.

6. In a horizontal form, fill and seal wrapping machine including means for continually unwinding and forming a strip of thermoplastic web material into a tube, means for depositing longitudinally spaced articles in said tube, and cooperating opposed pairs of rotary tucking means moving in the direction of web movement to engage and tuck web portions between said spaced articles, said rotary tucking means being rotatable about spaced pairs of axes lying in the same or substantially the same plane disposed transversely of the direction of movement of the tube, the improvement in said tucking means comprising means for concurrently driving said tucking means to substantially simultaneously engage and tuck the opposed panels of the web tube, one pair of said tucking means being heated and provided with web severing means to, respectively, seal and sever the web tube along a line in said plane transverse to the direction of web movement, and the other pair of tucking means being formed with integral fingers spaced a fixed distance laterally of each other and while tucking the opposed web tube portions toward each other said fingers being positioned on either side of said heated tucking means and thus straddling the web tube portion while sealing and severing occurs, certain ones of said laterally spaced fingers are formed with a tapered trailing edge for providing a gradually increasing spacing between said fingers from the free ends thereof toward the base of each finger to avoid interference with the currently formed seal.

7. In a horizontal form, fill and seal wrapping machine including means for continually unwinding and forming a strip of thermoplastic web material into a tube, means for depositing longitudinally spaced articles in said tube, and cooperating opposed pairs of rotary tucking means moving in the direction of web movement to engage and tuck web portions between said spaced articles, said rotary tucking means being rotatable about spaced pairs of axes lying in the same or substantially the same plane disposed transversely of the direction of movement of the tube, the improvement in said tucking means comprising means for concurrently driving said tucking means to substantially simultaneously engage and tuck the opposed panels of the web tube, one pair of said tucking means being heated and provided with web severing means to, respectively, seal and sever the web tube along a line in said plane transverse to the direction of web movement and the other pair of tucking means being formed with integral fingers spaced a fixed distance laterally of each other and while tucking the opposed web tube portions toward each other, said fingers being positioned on either side of said heated tucking means and thus straddling the web tube portion while sealing and severing occurs, said other tucking means each comprises a rigid flat member formed with an elongate shank and oppositely directed spaced fingers, said fingers being positioned relative to said shank so that one of said fingers is closer to the axis of symmetry of said shank.

* * * * *